United States Patent [19]

Sloop

[11] 4,323,180

[45] Apr. 6, 1982

[54] CAMERA SHOULDER CASE

[76] Inventor: Conrad B. Sloop, 9092 Bermuda Dr., Huntington Beach, Calif. 92646

[21] Appl. No.: 134,183

[22] Filed: Mar. 26, 1980

[51] Int. Cl.[3] ..... A45F 5/00

[52] U.S. Cl. ..... 224/202; 224/205; 150/33

[58] Field of Search ..... 224/202, 188, 197, 208, 224/257, 908, 909, 205; 150/33; 190/57

[56] References Cited

U.S. PATENT DOCUMENTS

| | | | |
|---|---|---|---|
| 1,164,833 | 12/1915 | Macaulay | 150/33 |
| 1,192,564 | 7/1916 | Rogers | 150/33 |
| 3,186,461 | 6/1965 | Erickson | 150/33 X |
| 3,910,470 | 10/1975 | Swenson et al. | 224/208 |

*Primary Examiner*—Steven M. Pollard
*Attorney, Agent, or Firm*—Freilich, Hornbaker, Wasserman, Rosen & Fernandez

[57] ABSTRACT

A camera shoulder case is provided which permits rapid opening, full visibility, and easy access to one layer of securely held equipment in the case while the case remains supported by a shoulder strap on the user. The assembly includes a lower case part which holds the equipment, a cover pivotally mounted to the rear of the lower case part, and a shoulder strap having opposite ends mounted to opposite sides of the lower case part. A flexible loop member which is mounted to the cover, slidably receives the shoulder strap. With the case supported on a person, access is obtained by pulling up on the cover to pivot down the lower case part until it is horizontal, the strap-receiving loop then resisting closing of the cover. The lower case part can be partitioned by the user to securely hold equipment by the use of pylon devices that can be installed in selected holes of an array of holes formed at the bottom of the lower case part.

9 Claims, 5 Drawing Figures

FIG. 1
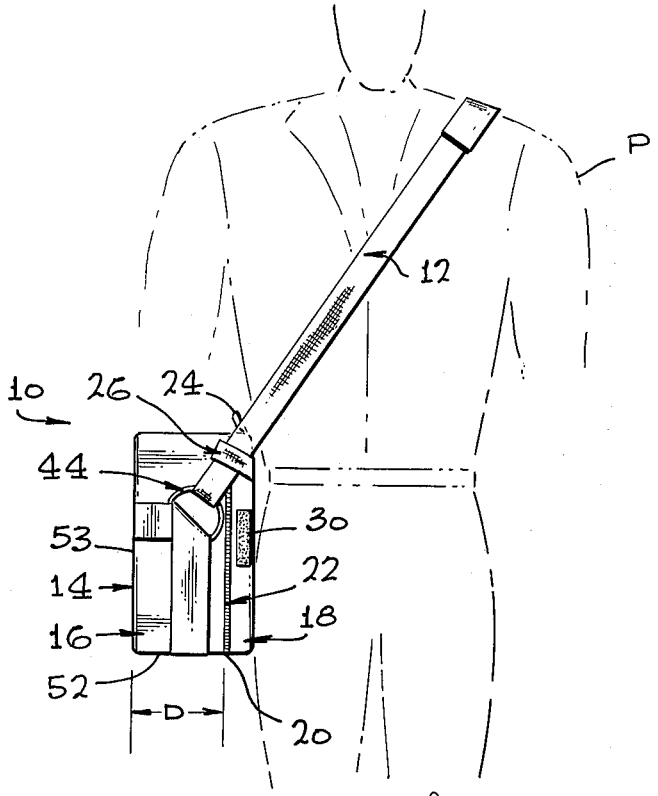
FIG. 2
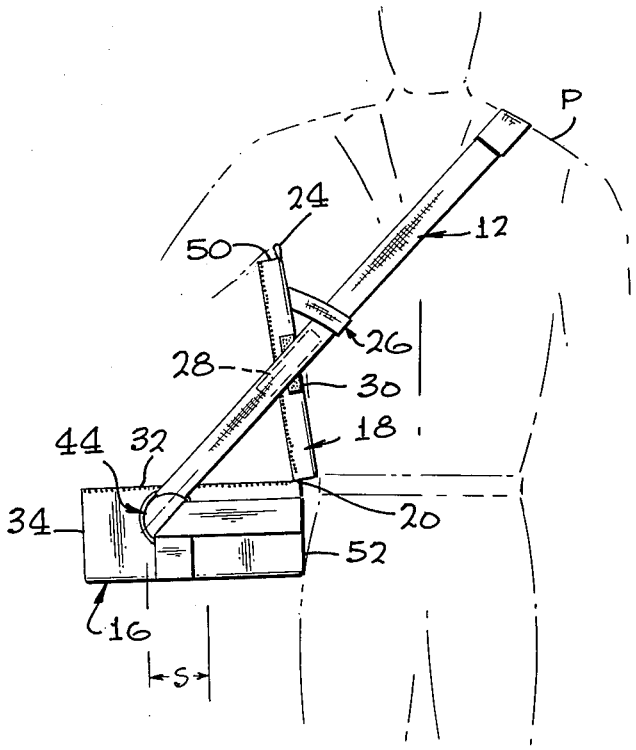
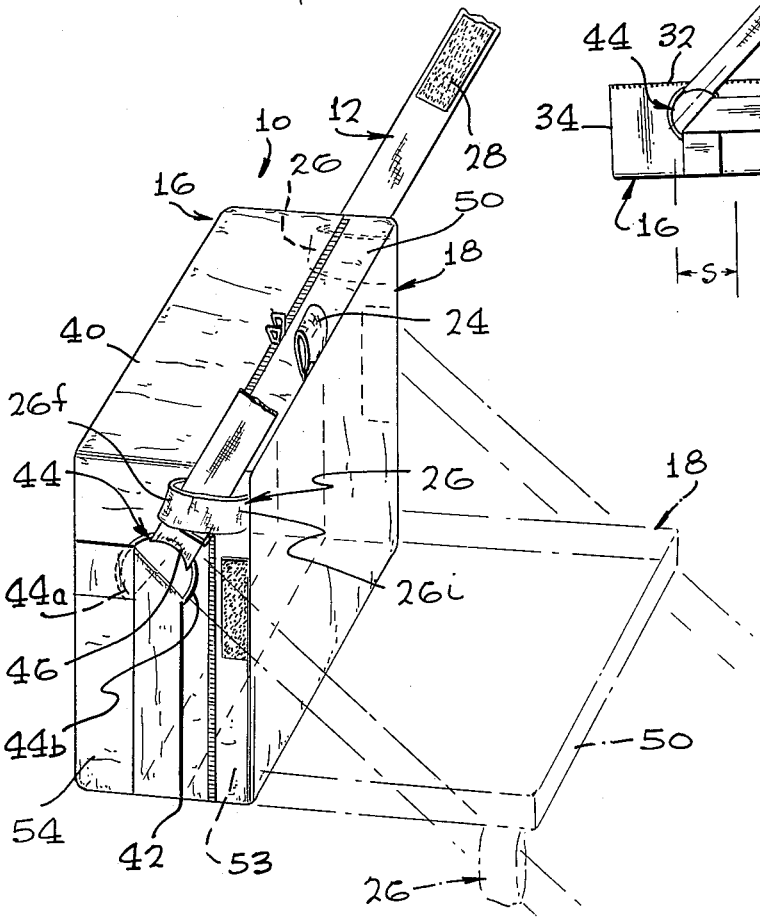
FIG. 3

CAMERA SHOULDER CASE

BACKGROUND OF THE INVENTION

A photographer often carries a camera bag by means of a strap hung around his neck, to provide access to a variety of equipment such as a camera, lenses, filters, flash unit, film, etc. Such bags typically have a thickness of less than one foot to avoid excessive bulging from the side of the user, but have a length and width greater than the thickness. A common type of camera bag has a small cover at the top, so that equipment near the top of the bag may have to be removed to recover equipment near the bottom of the bag. Another type of bag is of the "attache case" type which has a large cover at the side to enable direct access to all equipment, and which permits all equipment to be securely held in place. However, such bags, or cases, usually must be removed from the user's shoulder and placed on a table, before opening the cover. It is possible to provide shoulder case designs with relatively cumbersome and complex mechanisms that will hold an attache case open while it is held on the shoulder of the user, and U.S. Pat. No. 3,363,814 by Hall shows such a case. However, the use of complex mechanisms can greatly detract from the usefulness of the case, because potential customers may not readily understand how to operate the mechanism, and because the additional complexity adds to cost and decreases reliability. An attache-type case for providing ready access to securely held equipment, which could be opened while securely held on the shoulder of a person, and which was of simple design and easy operation, would be of considerable benefit.

An important advantage of an attache-type instrument case, wherein a large cover provides wide area access to equipment in the case, is that it enables equipment of irregular shape to be securely held in place. One technique for securely holding such equipment is to provide a thick foam cushion sheet that fills the entire lower part of the case, and in which large irregular holes have been cut on a custom basis to closely fit particular pieces of equipment. This technique does not permit an individual to easily rearrange the placement of his equipment or add new equipment without recutting the sheet, and can be difficult and result in a sloppy appearance when the work is done by the individual user. A case with cushion surroundings for each piece of equipment, which could be easily changed in configuration to hold different pieces of equipment, all in a sturdy, cushioned and neat-appearing manner, would be of considerable value.

SUMMARY OF THE INVENTION

In accordance with one embodiment of the present invention, an instrument case is provided which is of relatively simple design and which can be utilized in a simple and convenient manner. A shoulder case having a strap that can be hung from the neck of a user, includes a lower case part for holding instruments and a cover pivotally mounted on the lower case part. A loop member mounted on the cover, slidably receives the shoulder strap. When the cover is opened so the case pivots down to nearly the horizontal, the engagement of the loop on the cover of the strap prevents automatic closing or catastrophic opening of the case. Where a more rigid holding of the cover is an open position is desired, a fastener, such as of the Velcro type, can be mounted on the strap and cover to prevent relative movement of the case to the strap.

A custom fittable instrument case includes numerous pylon devices that can be mounted at any of a large number of positions in a lower case part. The lower case part can include a rigid bottom tray wall having an array of holes therein, and can also include a cushion layer formed of a material such as resilient foamed plastic lying over the tray wall and having an array of holes aligned with those in the tray wall. Each pylon device includes a stud portion which can be projected through aligned holes in the cushion and rigid tray wall and fastened in place thereat, and an upstanding post surrounded by a cushion layer. A user can position a group of pylon devices in the lower case part to closely fit around pieces of equipment of particular shape, to securely hold the equipment in a firm but cushioned manner at both vertical and horizontal positions of the case, while permitting easy removal and replacement of the equipment in the case.

The novel features of the invention are set forth with particularity in the appended claims. The invention will be best understood from the following description when read in conjunction with the accompanying drawings.

BRIEF DESCRIPTION OF THE DRAWINGS

FIG. 1 is a front elevation view of an instrument case apparatus constructed in accordance with the present invention, shown held on the shoulder of a user and with the case in a closed configuration.

FIG. 2 is a view similar to FIG. 1, but showing the case in an open configuration.

FIG. 3 is a partial perspective view of the case of FIG. 1, shown in a closed configuration.

DESCRIPTION OF THE PREFERRED EMBODIMENT

Figure 4:
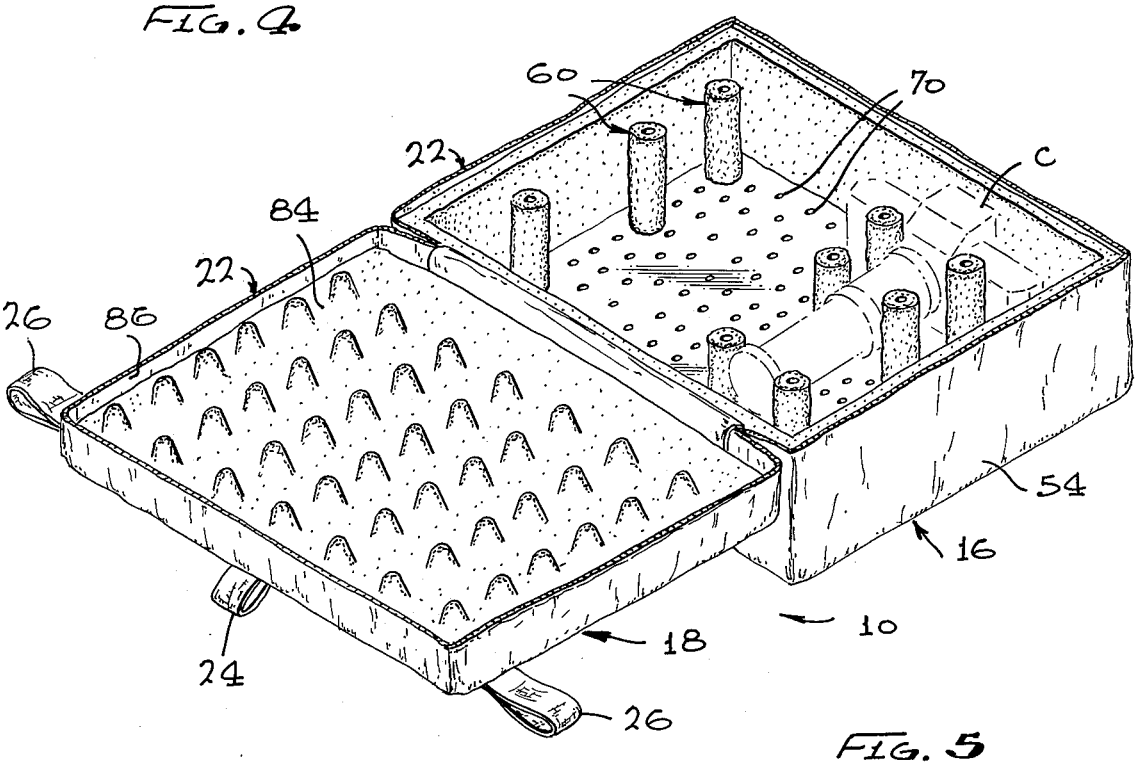
FIG. 4 is a perspective view of the case of FIG. 3, shown in an open configuration, but without the straps thereof.

FIG. 1 illustrates an instrument case apparatus 10 (which is sometimes referred to as a case or camera bag) that includes a flexible shoulder strap 12 held on the shoulder of a person P to suspend a container or case 14 at the side of a person. The case 14 includes a lower case part 16 having a considerable depth D to receive equipment carried by the apparatus, and a cover 18 pivotally mounted to the rear of the lower case part at 20. When a person wishes to gain access to the lower case part 16, he first unzips a zipper 22. He then lifts a pull-up tab 24, which causes the lower case part 16 to pivot down to the position shown in FIG. 2.

With the case open as in FIG. 2, the cover 18 tends to remain open largely because of the provision of a retainer member or loop 26 extending from the cover, which slidably engages the shoulder strap 12. A more secure positioning of the cover in its open position is achieved by the person pressing a location on the strap against the cover, to engage another retainer formed by a Velcro (hook-and-loop fastener type) pad 28 with a corresponding Velcro pad 30 at the side of the cover. The Velcro pads allow the cover 18 to be firmly supported by the shoulder strap, so the cover 18, in turn, supports the rear 52 of the lower case part to prevent the case from rotating closed. The loop 26 serves as a safety device to avoid overturning of the lower case part, since such overturning would require lifting of the cover which is resisted by the loop 26.

With the cover open, the person can view the open top 32 of the lower case part 16 to gain access to it so as to remove or replace equipment therein. It may be noted that a person may swing the lower case part 16 slightly forward around his body to facilitate such access to the opened case. A person can close the cover by lifting up the outer or forward end 34 of the lower case part towards the cover 18. Either before or after this, he also may pull the Velcro pads 28, 30 away from one another, to permit the strap to extend tautly to the lower case part, to again achieve the configuration shown in FIG. 1. The case apparatus will remain in this configuration even without closing the zipper 22, so long as the case continues to be held by the shoulder strap on the shoulder of a person. When the strap is removed from the person's shoulder, as to set the case on the ground, the loop 26 prevents the case from opening so long as the apparatus is held by the strap.

As also shown in FIG. 3, the lower case part 16 has a soft outer shell or case wall 40 and a coupling belt 42 that extends partially about the outer case wall. A D-ring 44 connects the coupling belt 42 to the end 46 of the strap 12. The end 46 of the strap is looped about a curved portion of the D-ring, so that the strap end can slide along the ring, to engage the ring portion **44*a* when the case is closed and to engage another ring portion 44*b*** when the case is open. The D-ring prevents the strap from twisting (which could occur if the strap ends were merely sewn to the lower case sides), which could prevent the Velcro pads from engaging.

The loop 26 which engages the shoulder strap is formed of a length of flexible material similar to that of the strap, and with opposite end of the length of material fastened to the cover 18. This provides a loop with an inner end **26*i* fastened to the cover and a free loop end 26*f*. When the case is closed as shown in FIG. 1, the loop 26 extends towards the bottom 53 of the case to lie beside the lower case part 16, under the influence of the strap 12. However, when the case is opened so that the front portion 50 of the cover is raised to the position of FIG. 2, the flexible loop extends in an opposite direction away from the lower case part. With the loop 26 at the position shown in FIG. 2, the loop engagement with the strap 12 prevents unintentional closing of the cover, since closing of the cover without movement of the lower case part 16 is prevented by the loop. Since the loop 26 is a flexible member, however, it would allow some movement of the cover towards and away from the lower case part in the open position of FIG. 2. Such "floppiness" of the cover position is avoided by the use of the Velcro fastener pads 28, 30. The engagement of these pads 28, 30, plus the fact that the shoulder strap 12 is under tension and therefore acts like a rigid member, results in the pad 28** preventing the cover from pivoting closed or further open.

The lower case part 16 lying in the open position of FIG. 2, is supported in a relatively stable manner against the hip portion of the person P. This is partially due to the fact that the lower case part 16 is of appreciable depth and presses with some force against the side of the person when open due to the angle of the strap 12. Also, the strap-supported cover supports the rear 42 of the lower case part. The lower end 46 of the strap is attached to a location not far from the mid point between the front 34 and rear 42 of the lower case part, to avoid any large tendency for the lower case part to pivot. The actual mounting location for the lower strap end at 46 is somewhat closer to the front 34 of the lower case part than the rear 52 to avoid falling over of the lower case part which could be catostrophic. A more detailed analysis shows that the centerline of the strap is spaced a horizontal distance S from the center of gravity of the lower case part, and the D-ring 44 does not permit any further movement of the strap towards the center of gravity, all of which helps avoid falling over of the lower case part. The case apparatus is constructed symmetrically, with its opposite sides 54, 56 each coupled by a D-ring to a lower end of the strap 12, with a flexible loop 26 extending from each side of the cover, and with a Velcro pad 28 mounted on the inner face of each end portion of the shoulder strap.

Figure 5:
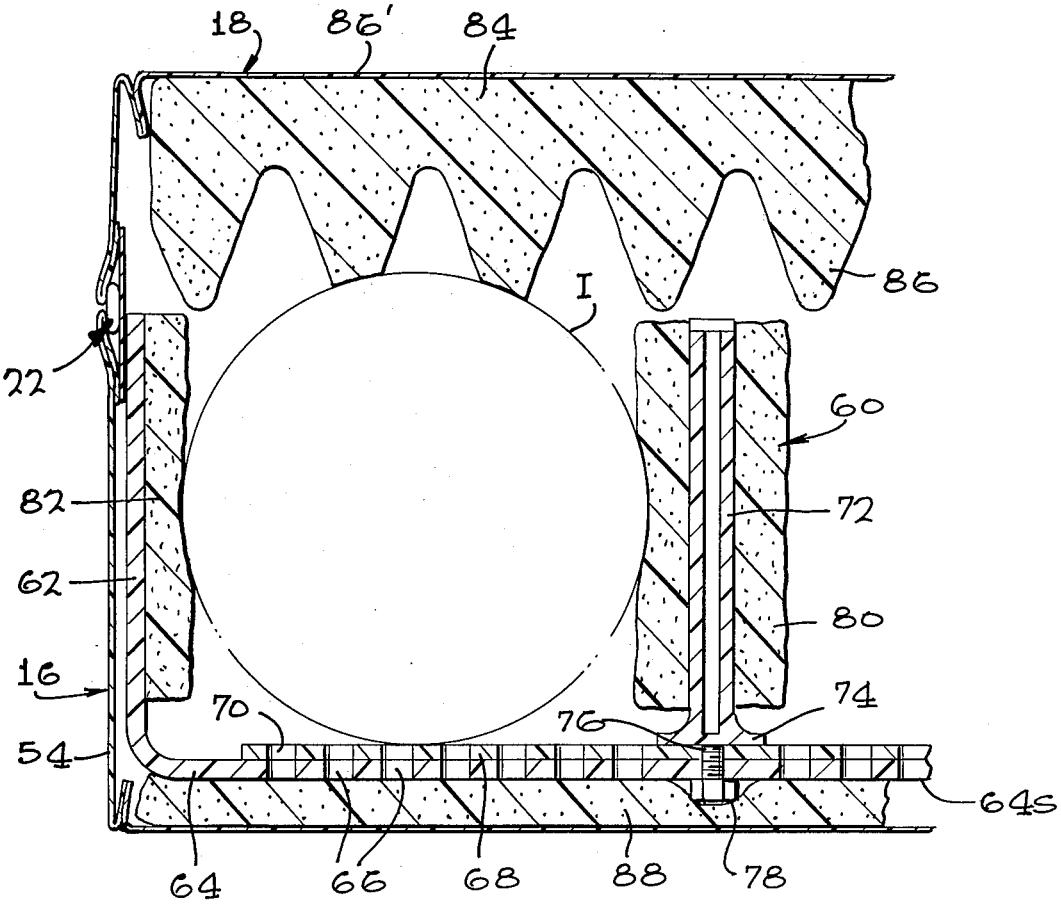
FIG. 5 is a partial sectional view of the case of FIG. 4, but shown in a closed configuration.

FIGS. 4 and 5 show the inside of the case, and particularly the lower case part 16. It is well recognized that delicate instruments should be securely held to the case to prevent movement relative to it, which could cause damage when the instruments strike one another or the case walls. In accordance with another feature of the present invention, pylon devices 60 are provided which can be mounted at any of a large number of positions within the case lower part so as to conform with the shape of an instrument to be held. The pylon devices have foam plastic coverings around them, as do the inside walls of the lower case part, to gently hold the instrument and minimize the transmission of shocks to them. The pylon devices have rigid cores, to prevent shifting of the equipment when the case is pivoted to the vertical.

As shown in FIG. 5, the lower case part 16 includes a rigid tray 62 which is in the form of a container with four sides and a bottom wall 64. The bottom tray wall 64 has an array of holes 66 therein for mounting the pylon devices. A cushion layer 68 lies over the rigid bottom tray wall 64 to cushion and prevent scratching of equipment. The cushion layer 68 also has an array of holes 70 which are aligned with those 66 of the rigid tray wall. Each pylon device 60 includes a rigid upstanding post 72 with a base 74 lying on the cushion layer 68, and a stud 76 which projects through aligned holes in the cushion layer and rigid tray wall 68,64. A nut 78 is fastened to a threaded end of the stud 76 to securely hold the pylon in place. The pylon device also has a thick-wall resilient foam tube 80 surrounding the upstanding post 72. It may be noted that instead of using a nut 78 on a threaded stud, a bolt can be used whose threaded stud screws into a hole in the post, but this would make initial positioning of the pylon devices less convenient. It is also possible to thread the holes in the bottom tray wall, although this can be more expensive, even though more convenient.

The pylon device 60 can be mounted to securely hold an instrument I between the pylon 60 and another pylon or a foam pad 82 at the inside wall of the case. This is accomplished by positioning the pylon device so that the space between it and the other pylon device or the pad 82, is less than the width of the instrument to compress the elastic foam material at 80 and 82. Since the foam tube or layer 80 on the pylon device is of substantially constant diameter along the depth direction of the lower case part, the equipment can be easily removed by lifting it directly upwardly (when the bottom tray wall 64 is horizontal).

The cover 18 of the case apparatus is formed with a molded elastic foam pad 84 having multiple protuberances 86 thereon that deform against any instrument I of sufficient height. The cover also has a soft outer wall 86. In the lower case part 16, the bottom tray wall 64 is spaced from the soft outer wall 54 by a foam pad 88. The foam pad can readily deform to receive the indentations applied thereto by the nuts 78 of the pylon devices.

The pylon devices 60 permit secure holding of an instrument such as a camera C (FIG. 4) with telephoto lens thereon. This can be accomplished by removing the tray 62 from the rest of the lower case part, so that the lower surface 64*s* (FIG. 5) of the bottom tray wall 64 is exposed. Then, a group of pylon devices 60 can be positioned by inserting their studs 76 through appropriate holes of the cushion and bottom tray walls 68, 64, so that the equipment is snugly held between the pylons and/or the inner foam side walls 82 mounted on the tray. Each pylon device is fastened in place by attaching a nut 78 to it. The tray with pylon devices attached thereon then can be replaced in the rest of the lower case part. Thereafter, the camera or other equipment for which the pylons have been fitted can be fitted out or reinserted into the spaces left between the pylons.

The pylons occupy only a small amount of space, so that the gaps left by large irregularly-shaped equipment, can be utilized to hold other equipment. The fact that the pylons have rigid upstanding posts or covers, permits them to very securely hold equipment so it will not fall out even if the case is accidently turned over. However, the cushioned outside of each pylon permits equipment to be pulled out and later reinstalled.

Thus, the invention provides an instrument case or bag apparatus which is of relatively simple construction, but which enables highly convenient utilization. The case is of the "attache case" type with a large cover permitting wide area access, and yet can be easily opened and closed while remaining held on the shoulder of a person. This is accomplished by supporting a lower case part at the ends of a shoulder strap and by utilizing a loop on the cover which slidably engages the strap. When the cover is pulled up to thereby pivot down the lower case part so the case is opened, the loop which slidably engages the strap thereafter prevents automatic closing of the case. An additional fastener device such as of the Velcro type can be utilized to provide a more rigid holding-open of the case. The inside space of the case can be divided so as to securely hold instruments of irregular shape, by the provision of pylon devices that can be mounted at a large number of different selected positions within the case. The pylon devices permits utilization of a large proportion of the space, because the pylon devices do not occupy a large amount of space even when holding irregular equipment. The case can include a bottom tray wall having an array of holes therein, and the pylon devices can be provided with studs that project through the holes and are fastened thereto. A cushion layer can be provided on the rigid bottom tray wall to cushion instruments, and the cushion and tray can be provided with aligned holes through which the pylon studs can be projected. The pylons have upstanding posts with elastic foam tubes thereon to securely hold and cushion the instruments.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An instrument case apparatus that can be carried on the shoulder and opened while still on the shoulder, comprising:

a lower case part having opposite side walls, and having a front, rear, bottom, and open top;

a cover pivotally mounted to the rear of the lower case part, to open and close over the top of the lower case parts;

a shoulder strap having opposite ends mounted to said opposite side walls of said lower case part; and fastener means operable after the cover has been opened, for fastening together locations on said strap and cover to prevent movement of said strap relative to said cover in a direction which would close the cover, so that stiffness of the strap against compression along its length when the strap is under tension by carrying it on the shoulder, can be utilized to prevent the cover from closing.

2. The apparatus described in claim 1 wherein:

said lower case part includes a ring member with a curved portion, fastened to each side of the case part, with the axis of the hole in each ring extending substantially parallel to the axis of pivoting of the cover on the lower case part, and each end of said strap is looped about the curved ring portion to slide thereon so as to enable a change in the direction in which the strap extends away from the lower case part.

3. The apparatus described in claim 1 wherein:

the opposite ends of said shoulder strap are mounted at locations closer to the front than to the rear of said lower case part, whereby to avoid overturning of an opened case.

4. In a shoulder case which includes a lower case part and a cover pivotally mounted on the lower part, and a shoulder strap having a central portion that fits over the shoulder of a person and opposite strap portions which are free of attachment to one another except that the ends of said portions are fastened to opposite sides of the lower case part, the improvement comprising:

a pair of flexible loops each attached to a different side of the cover and slideably receiving one of said strap portions; and a first hook-and-loop type fastener pad mounted on a side of said cover, and a mating second hook-and-loop type fastener pad mounted on the side of a strap portion which faces the cover at a location to engage said first pad when the cover is pivoted open.

5. An instrument case apparatus that can be carried on the shoulder and opened while still on the shoulder, comprising:

a lower case part having a front, a rear, opposite sides, a bottom, and an open top;

a cover having a front, a rear, and opposite sides, the rear of said cover being pivotally mounted to the rear of said lower case part;

a shoulder strap having first and second ends mounted to opposite sides of said lower case part; and a retainer member which comprises a flexible element extending in a loop and slideably receiving said shoulder strap so the shoulder strap can hold the element to resist closing of the opened cover, one side of said loop secured to said cover and the other being free to move, so the loop can extend below the cover to lie on a side of the lower case part when the cover is closed and can extend away from the lower case part when the cover is open.

6. An instrument case apparatus that can be carried on the shoulder and opened while still on the shoulder, comprising:

a lower case part having a front, a rear, opposite sides, a bottom, and an open top;

a cover having a front, a rear, and opposite sides, the rear of said cover being pivotally mounted to the rear of said lower case part;

a shoulder strap having first and second ends mounted to opposite sides of said lower case part;

a retainer member having one part connected to said cover and another moveable part, said retainer member slideably receiving said shoulder strap, so the shoulder strap can hold the retainer member to resist closing of the opened cover; and means operable after the cover has been opened, to engage said strap to said cover for preventing movement of said cover relative to said strap when the cover is open, said operable means including first and second fastener devices which hold to one another when merely pressed together, a first of said fastener devices mounted at one side of said cover and the second one mounted at the inside of said strap at a location to lie opposite the first fastener device when the cover is pivoted open by about 90° from a closed position.

7. An instrument case apparatus that can be carried on the shoulder and opened while still on the shoulder, comprising:

a lower case part having opposite side walls, and having a front, rear, bottom, and open top;

a cover pivotally mounted to the rear of the lower case part, to open and close over the top of the lower case part;

a shoulder strap having opposite ends mounted to said opposite side walls of said lower case part; and a flexible loop having an inner end mounted on said cover at a location spaced forward of the rear of the cover, and having a free outer end, said strap extending through said loop and slideable therealong.

8. An instrument case apparatus that can be carried on the shoulder and opened while still on the shoulder, comprising:

a lower case part having opposite side walls, and having a front, rear, bottom, and open top;

a cover pivotally mounted to the rear of the lower case part, to open and close over the top of the lower case part;

a shoulder strap having opposite ends mounted to said opposite side walls of said lower case part; and means on said cover at a location spaced forward of the rear of said cover, for holding said cover to a strap location which is spaced a plurality of inches above said lower case part;

said shoulder strap having an element of the hook-and-loop fastener type thereon, and said holding means including another element of the hook-and-loop fastener type mounted on said cover, which mates with the element on the strap when pressed thereagainst.

9. An instrument case apparatus that can be carried on the shoulder and opened while still on the shoulder, comprising:

a lower case part having a front, a rear, opposite sides, a bottom, and an open top;

a cover having a front, a rear, and opposite sides, the rear of said cover being pivotally mounted on the rear of said lower case part;

a shoulder strap having first and second ends mounted to opposite sides of said lower case part;

a retainer mounted on said cover and slideably receiving said shoulder strap; and fastener means operable after the cover has been opened to prevent slideable movement of said strap relative to said cover in a direction which would close the cover, so that stiffness of the strap against compression along its length when the strap is under tension by carrying it on the shoulder, can be utilized to prevent the cover from closing.

* * * * *